US009895699B2

(12) United States Patent
Short et al.

(10) Patent No.: US 9,895,699 B2
(45) Date of Patent: Feb. 20, 2018

(54) CIRCUIT-BASED OPTOELECTRONIC TWEEZERS

(71) Applicant: Berkeley Lights, Inc., Emeryville, CA (US)

(72) Inventors: Steven W. Short, Pleasanton, CA (US); Ming C. Wu, Moraga, CA (US)

(73) Assignee: Berkeley Lights, Inc., Emeryville, CA (US)

( * ) Notice: Subject to any disclaimer, the term of this patent is extended or adjusted under 35 U.S.C. 154(b) by 0 days.

(21) Appl. No.: 15/207,210

(22) Filed: Jul. 11, 2016

(65) Prior Publication Data

US 2016/0318038 A1 Nov. 3, 2016

Related U.S. Application Data

(63) Continuation of application No. 14/051,004, filed on Oct. 10, 2013, now Pat. No. 9,403,172.

(60) Provisional application No. 61/724,168, filed on Nov. 8, 2012.

(51) Int. Cl.

| | |
|---|---|
| ***B03C 5/00*** | (2006.01) |
| ***B03C 5/02*** | (2006.01) |
| ***B01L 3/00*** | (2006.01) |

(52) U.S. Cl.

CPC ..... *B03C 5/005* (2013.01); *B01L 3/502761* (2013.01); *B03C 5/026* (2013.01); *B01L 2400/0424* (2013.01); *B03C 2201/26* (2013.01)

(58) Field of Classification Search

CPC ..... B01L 3/502761; B03C 2201/26; B03C 5/005; B03C 5/026

See application file for complete search history.

(56) References Cited

U.S. PATENT DOCUMENTS

| | | | |
|---|---|---|---|
| 6,294,063 | B1 | 9/2001 | Becker et al. |
| 6,942,776 | B2 | 9/2005 | Medoro |
| 6,958,132 | B2 | 10/2005 | Chiou et al. |
| 7,090,759 | B1 | 8/2006 | Seul |
| 7,612,355 | B2 | 11/2009 | Wu et al. |
| 7,956,339 | B2 | 6/2011 | Ohta et al. |
| 2005/0112548 | A1 | 5/2005 | Segawa et al. |
| 2006/0175192 | A1 | 8/2006 | Lin |
| 2009/0170186 | A1 | 7/2009 | Wu et al. |

(Continued)

FOREIGN PATENT DOCUMENTS

KR 10-2010-0008222 A 1/2010

OTHER PUBLICATIONS

Fuchs et al., Electronic Sorting and Recovery of Single Live Cells from Microlitre Sized Samples, Lab Chip (Nov. 15, 2005), 6, pp. 121-126.

(Continued)

*Primary Examiner* — Francis M Legasse, Jr.
(74) *Attorney, Agent, or Firm* — Kenneth E. Horton; Kirton McConkie

(57) ABSTRACT

A microfluidic optoelectronic tweezers (OET) device can comprise dielectrophoresis (DEP) electrodes that can be activated and deactivated by controlling a beam of light directed onto photosensitive elements that are disposed in locations that are spaced apart from the DEP electrodes. The photosensitive elements can be photodiodes, which can switch the switch mechanisms that connect the DEP electrodes to a power electrode between an off state and an on state.

23 Claims, 8 Drawing Sheets

(56) References Cited

U.S. PATENT DOCUMENTS

| | | | | |
|---|---|---|---|---|
| 2009/0184331 | A1* | 7/2009 | Omi | H01L 27/14621 257/80 |
| 2010/0000620 | A1 | 1/2010 | Fouillet et al. | |
| 2010/0206731 | A1 | 8/2010 | Lau et al. | |
| 2012/0024708 | A1 | 2/2012 | Chiou et al. | |
| 2012/0118740 | A1 | 5/2012 | Garcia et al. | |
| 2012/0325665 | A1 | 12/2012 | Chiou et al. | |
| 2013/0026040 | A1 | 1/2013 | Cheng et al. | |
| 2015/0166326 | A1* | 6/2015 | Chapman | B03C 5/005 204/452 |

OTHER PUBLICATIONS

Issadore et al., A Microfluidic Microprocessor: Controlling Biomimetic Containers and Cells Using Hybrid Integrated Circuit/Microfluidic Chips, Lab Chip (2010, 10, pp. 2937-2943.

Manaresi et al., A CMOS Chip for Individual Cell Manipulation and Detection, IEEE Journal of Solid-State Circuits, vol. 38, No. 12 (Dec. 2003), pp. 2297-2305.

International Searching Authority, The International Search Report and Written Opinion of PCT/US2013/067564, Feb. 5, 2014, 10 pages.

* cited by examiner

CIRCUIT-BASED OPTOELECTRONIC TWEEZERS

CROSS REFERENCE TO RELATED APPLICATION(S)

This application is continuation of U.S. patent application Ser. No. 14/051,004, filed Oct. 10, 2013, which is a non-provisional (and thus claims the benefit of the filing date of) U.S. provisional patent application No. 61/724,168 filed Nov. 8, 2012, the disclosures of which are incorporated herein by reference in their entirety.

BACKGROUND

Optoelectronic microfluidic devices (e.g., optoelectronic tweezers (OET) devices) utilize optically induced dielectrophoresis (DEP) to manipulate objects (e.g., cells, particles, or the like) in a liquid medium. FIGS. 1A and 1B illustrate an example of a simple OET device 100 for manipulating objects 108 in a liquid medium 106 in a chamber 104, which can be between an upper electrode 112, sidewalls 114, photoconductive material 116, and a lower electrode 124. As shown, a power source 126 can be applied to the upper electrode 112 and the lower electrode 124. FIG. 1C shows a simplified equivalent circuit in which the impedance of the medium 106 in the chamber 104 is represented by resistor 142 and the impedance of the photoconductive material 116 is represented by the resistor 144.

Photoconductive material 116 is substantially resistive unless illuminated by light. While not illuminated, the impedance of the photoconductive material 116 (and thus the resistor 144 in the equivalent circuit of FIG. 1C) is greater than the impedance of the medium 106 (and thus the resistor 142 in FIG. 1C). Most of the voltage drop from the power applied to the electrodes 112, 124 is thus across the photoconductive material 116 (and thus resistor 144 in the equivalent circuit of FIG. 1C) rather than across the medium 106 (and thus resistor 142 in the equivalent circuit of FIG. 1C).

A virtual electrode 132 can be created at a region 134 of the photoconductive material 116 by illuminating the region 134 with light 136. When illuminated with light 136, the photoconductive material 116 becomes electrically conductive, and the impedance of the photoconductive material 116 at the illuminated region 134 drops significantly. The illuminated impedance of the photoconductive material 116 (and thus the resistor 144 in the equivalent circuit of FIG. 1C) at the illuminated region 134 can thus be significantly reduced, for example, to less than the impedance of the medium 106. At the illuminated region 134, most of the voltage drop is now across the medium 106 (resistor 142 in FIG. 1C) rather than the photoconductive material 116 (resistor 144 in FIG. 1C). The result is a non-uniform electrical field in the medium 106 generally from the illuminated region 134 to a corresponding region on the upper electrode 112. The non-uniform electrical field can result in a DEP force on a nearby object 108 in the medium 106.

Virtual electrodes like virtual electrode 132 can be selectively created and moved in any desired pattern or patterns by illuminating the photoconductive material 116 with different and moving patterns of light. Objects 108 in the medium 106 can thus be selectively manipulated (e.g., moved) in the medium 106.

Generally speaking, the unilluminated impedance of the photoconductive material 116 must be greater than the impedance of the medium 106, and the illuminated impedance of the photoconductive material 116 must be less than the impedance of the medium 106. As can be seen, the lower the impedance of the medium 106, the lower the required illuminated impedance of the photoconductive material 116. Due to such factors as the natural characteristics of typical photoconductive materials and a limit to the intensity of the light 136 that can, as a practical matter, be directed onto a region 134 of the photoconductive material 116, there is a lower limit to the illuminated impedance that can, as a practical matter, be achieved. It can thus be difficult to use a relatively low impedance medium 106 in an OET device like the OET device 100 of FIGS. 1A and 1B.

U.S. Pat. No. 7,956,339 addresses the foregoing by using phototransistors in a layer like the photoconductive material 116 of FIGS. 1A and 1B selectively to establish, in response to light like light 136, low impedance localized electrical connections from the chamber 104 to the lower electrode 124. The impedance of an illuminated phototransistor can be less than the illuminated impedance of the photoconductive material 116, and an OET device configured with phototransistors can thus be utilized with a lower impedance medium 106 than the OET device of FIGS. 1A and 1B. Phototransistors, however, do not provide an efficient solution to the above-discussed short comings of prior art OET devices. For example, in phototransistors, the light absorption and electrical amplification for impedance modulation are typically coupled and thus constrained in independent optimization of both.

Embodiments of the present invention address the foregoing problems and/or other problems in prior art OET devices as well as provide other advantages.

SUMMARY

In some embodiments, a microfluidic apparatus can include a circuit substrate, a chamber, a first electrode, a second electrode, a switch mechanism, and photosensitive elements. Dielectrophoresis (DEP) electrodes can be located at different locations on a surface of the circuit substrate. The chamber can be configured to contain a liquid medium on the surface of the circuit substrate. The first electrode can be in electrical contact with the medium, and the second electrode can be electrically insulated from the medium. The switch mechanisms can each be located between a different corresponding one of the DEP electrodes and the second electrode, and each switch mechanism can be switchable between an off state in which the corresponding DEP electrode is deactivated and an on state in which the corresponding DEP electrode is activated. The photosensitive elements can each be configured to provide an output signal for controlling a different corresponding one of the switch mechanisms in accordance with a beam of light directed onto the photosensitive element.

In some embodiments, a process of controlling a microfluidic device can include applying alternating current (AC) power to a first electrode and a second electrode of the microfluidic device, where the first electrode is in electrical contact with a medium in a chamber on an inner surface of a circuit substrate of the microfluidic device, and the second electrode is electrically insulated from the medium. The process can also include activating a dielectrophoresis (DEP) electrode on the inner surface of the circuit substrate, where the DEP electrode is one of a plurality of DEP electrodes on the inner surface that are in electrical contact with the medium. The DEP electrode can be activated by directing a light beam onto a photosensitive element in the circuit substrate, providing, in response to the light beam, an output signal from the photosensitive element, and switching, in response to the output signal, a switch mechanism in the circuit substrate from an off state in which the DEP electrode is deactivated to an on state in which the DEP electrode is activated.

In some embodiments, a microfluidic apparatus can include a circuit substrate and a chamber configured to contain a liquid medium disposed on an inner surface of the circuit substrate. The microfluidic apparatus can also include means for activating a dielectrophoresis (DEP) electrode at a first region of the inner surface of the circuit substrate in response to a beam of light directed onto a second region of the inner surface, where the second region is spaced apart from the first region.

DETAILED DESCRIPTION OF EXEMPLARY EMBODIMENTS

This specification describes exemplary embodiments and applications of the invention. The invention, however, is not limited to these exemplary embodiments and applications or to the manner in which the exemplary embodiments and applications operate or are described herein. Moreover, the Figures may show simplified or partial views, and the dimensions of elements in the Figures may be exaggerated or otherwise not in proportion for clarity. In addition, as the terms "on," "attached to," or "coupled to" are used herein, one element (e.g., a material, a layer, a substrate, etc.) can be "on," "attached to," or "coupled to" another element regardless of whether the one element is directly on, attached, or coupled to the other element or there are one or more intervening elements between the one element and the other element. Also, directions (e.g., above, below, top, bottom, side, up, down, under, over, upper, lower, horizontal, vertical, "x," "y," "z," etc.), if provided, are relative and provided solely by way of example and for ease of illustration and discussion and not by way of limitation. In addition, where reference is made to a list of elements (e.g., elements a, b, c), such reference is intended to include any one of the listed elements by itself, any combination of less than all of the listed elements, and/or a combination of all of the listed elements.

As used herein, "substantially" means sufficient to work for the intended purpose. The term "ones" means more than one.

Figure 1A:
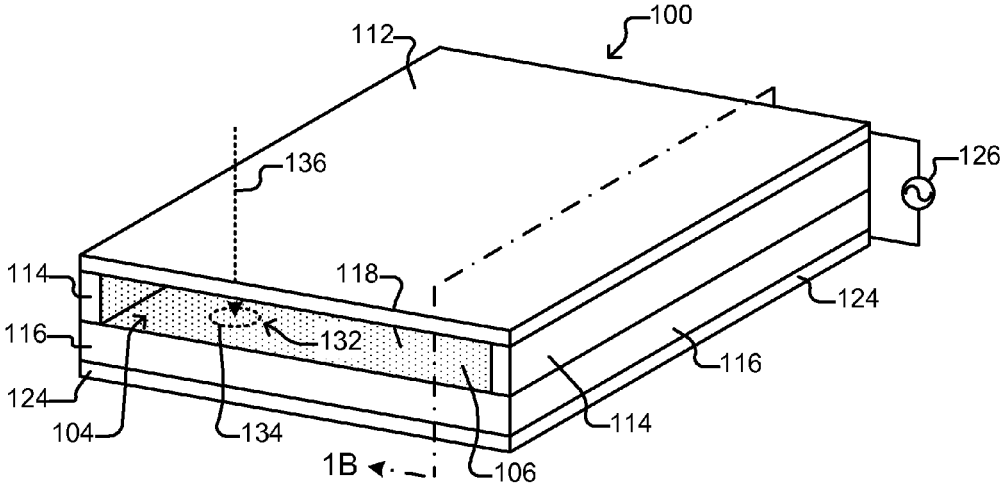
Figure 1A (Prior Art)
FIG. 1A illustrates a perspective view of a simplified prior art OET device.
Figure 1B:
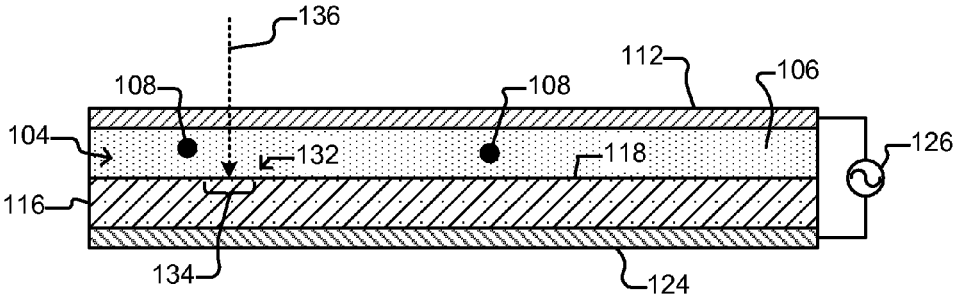
Figure 1B (Prior Art)
FIG. 1B shows a side, cross-sectional view of the OET device of FIG. 1A.
Figure 1C:
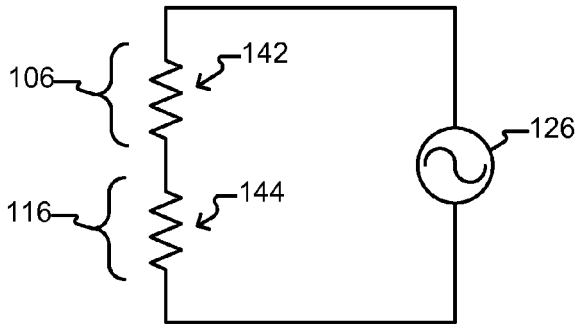
Figure 1C (Prior Art)
FIG. 1C is an equivalent circuit diagram of the OET device of FIG. 1A.
Figure 2A:
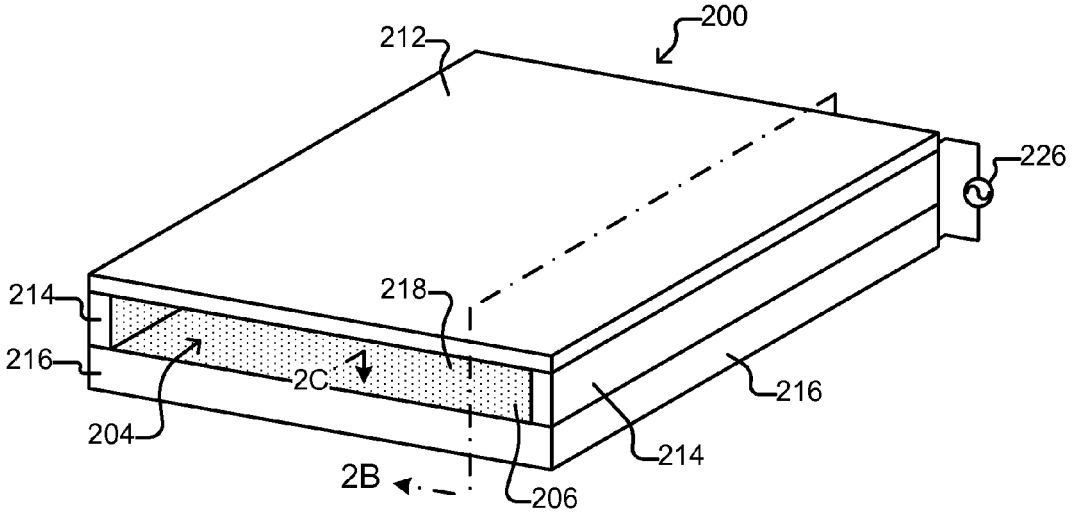
FIG. 2A is a perspective view of a simplified OET device according to some embodiments of the invention.
Figure 2B:
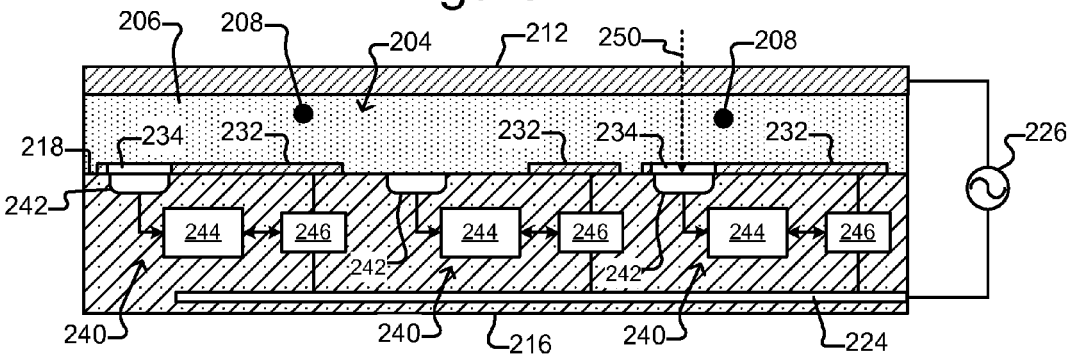
FIG. 2B shows a side, cross-sectional view of the OET device of FIG. 2A.
Figure 2C:
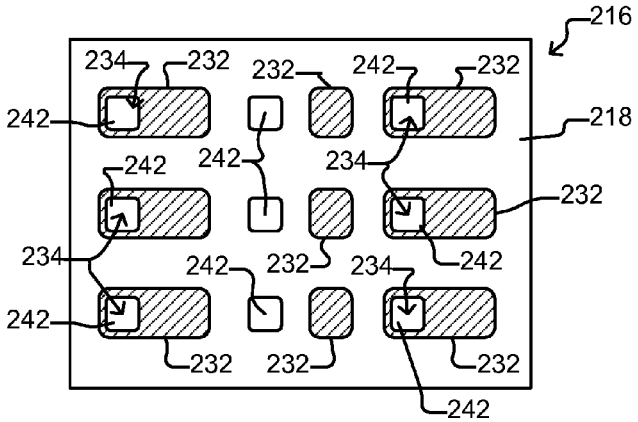
FIG. 2C is a top view of an inner surface of a circuit substrate of the OET device of FIG. 2A.

In some embodiments of the invention, dielectrophoresis (DEP) electrodes can be defined in an optoelectronic tweezers (OET) device by switch mechanisms that connect electrically conductive terminals on an inner surface of a circuit substrate to a power electrode. The switch mechanisms can be switched between an "off" state in which the corresponding DEP electrode is not active and an "on" state in which the corresponding DEP electrode is active. The state of each switch mechanism can be controlled by a photosensitive element connected to but spaced apart from the switch mechanism. FIGS. 2A-2C illustrate an example of such a microfludic OET device 200 according to some embodiments of the invention.

As shown in FIGS. 2A-2C, the OET device 200 can comprise a chamber 204 for containing a liquid medium 206. The OET device 200 can also comprise a circuit substrate 216, a first electrode 212, a second electrode 224, and an alternating current (AC) power source 226, which can be connected to the first electrode 212 and the second electrode 224.

The first electrode 212 can be positioned in the device 200 to be in electrical contact with (and thus electrically connected to) the medium 206 in the chamber 204. In some embodiments, all or part of the first electrode 212 can be transparent to light so that light beams 250 can pass through the first electrode 212. In contrast to the first electrode 212, the second electrode 224 can be positioned in the device 200 to be electrically insulated from the medium 206 in the chamber 204. For example, as shown, the circuit substrate 216 can comprise the second electrode 224. For example, the second electrode 224 can comprise one or more metal layers on or in the circuit substrate 216. Although illustrated in FIG. 2B as a layer inside the circuit substrate 216, the second electrode 224 can alternatively be part of a metal layer on the surface 218 of the circuit substrate 216. Regardless, such a metal layer can comprise a plate, a pattern of metal traces, or the like.

The circuit substrate 216 can comprise a material that has a relatively high electrical impedance. For example, the impedance of the circuit substrate 216 generally can be greater than the electrical impedance of the medium 206 in the chamber 204. For example, the impedance of the circuit substrate 216 can be two, three, four, five, or more times the impedance of the medium 206 in the chamber 204. In some embodiments, the circuit substrate 216 can comprise a semiconductor material, which undoped, has a relatively high electrical impedance.

As shown in FIG. 2B, the circuit substrate 216 can comprise circuit elements interconnected to form electric circuits (e.g., control modules 240, which are discussed below). For example, such circuits can be integrated circuits formed in the semiconductor material of the circuit substrate 216. The circuit substrate 216 can thus comprise multiple layers of different materials such as undoped semiconductor material, doped regions of the semiconductor material, metal layers, electrically insulating layers, and the like such as is generally known in the field of forming microelectronic circuits integrated into semiconductor material. For example, as shown in FIG. 2B, the circuit substrate 216 can comprise the second electrode 224, which can be part of one or more metal layers of the circuit substrate 216. In some embodiments, the circuit substrate 216 can comprise an integrated circuit corresponding to any of many known semiconductor technologies such as complementary metal-oxide semiconductor (CMOS) integrated circuit technology, bi-polar integrated circuit technology, or bi-MOS integrated circuit technology.

As shown in FIGS. 2B and 2C, the circuit substrate 216 can comprise an inner surface 218, which can be part of the chamber 204. As also shown, DEP electrodes 232 can be located on the surface 218. As best seen in FIG. 2C, the DEP electrodes 232 can be distinct one from another. For example, the DEP electrodes 232 are not directly connected to each other electrically.

As illustrated in FIGS. 2B and 2C, each DEP electrode 232 can comprise an electrically conductive terminal, which can be in any of many different sizes, shapes, and locations on the surface 218. For example, as illustrated by the DEP electrodes 232 in the middle column of DEP electrodes 232 of FIG. 2C, the conductive terminal of each DEP electrode 232 can be spaced apart from a corresponding photosensitive element 242. As another example, and as illustrated by the left and right columns of DEP electrodes 232 in FIG. 2C, the conductive terminal of each DEP electrode 232 can be disposed around (entirely as shown or partially (not shown)) and extend away from a corresponding photosensitive element 242, and those terminals can comprise an opening 234 (e.g., a window) through which a light beam 250 can pass to strike the photosensitive element 242. Alternatively, the terminals of such DEP electrodes 232 can be transparent to light and thus can cover a corresponding photosensitive element 242 without having an opening 234. Although the DEP electrodes 232 are illustrated in FIGS. 2B and 2C (and in other figures) as comprising an electrically conductive terminal, one or more of the DEP electrodes 232 can alternatively comprise merely a region of the surface 218 of the circuit substrate 216 where one of the switch mechanisms 246 is in electrical contact with the medium 206 in the chamber 204. Regardless, as can be seen in FIG. 2B, the inner surface 218 can be part of the chamber 204, and the medium 206 can be disposed on the inner surface 218 and the DEP electrodes 232.

As noted above, the circuit substrate 216 can comprise electric circuit elements interconnected to form electrical circuits. As illustrated in FIG. 2B, such circuits can comprise control modules 240, which can comprise a photosensitive element 242, control circuitry 244, and a switch mechanism 246.

As shown in FIG. 2B, each switch mechanism 246 can connect one of the DEP electrodes 232 to the second electrode 224. In addition, each switch mechanism 246 can be switchable between at least two different states. For example, the switch mechanism 246 can be switched between an "off" state and an "on" state. In the "off" state, the switch mechanism 246 does not connect the corresponding DEP electrode 232 to the second electrode 224. Put another way, the switch mechanism 246 provides only a high impedance electrical path from the corresponding DEP electrode 232 to the second electrode 224. Moreover, the circuit substrate 216 does not otherwise provide an electrical connection from the corresponding DEP electrode 232 to the second electrode 224, and thus there is nothing but a high impedance connection from the corresponding DEP electrode 232 to the second electrode 224 while the switch mechanism 246 is in the off state. In the on state, the switch mechanism 246 electrically connects the corresponding DEP electrode 232 to the second electrode 224 and thus provides a low impedance path from the corresponding DEP electrode 232 to the second electrode 224. The high impedance between the corresponding DEP electrode 232 while the switch mechanism 246 is in the off state can be a greater impedance than the medium 206 in the chamber 204, and the low impedance connection from the corresponding DEP electrode 232 to the second electrode 224 provided by the switch mechanism 246 in the on state can have a lesser impedance than the medium 206. The foregoing is illustrated in FIG. 3.

Figure 3:
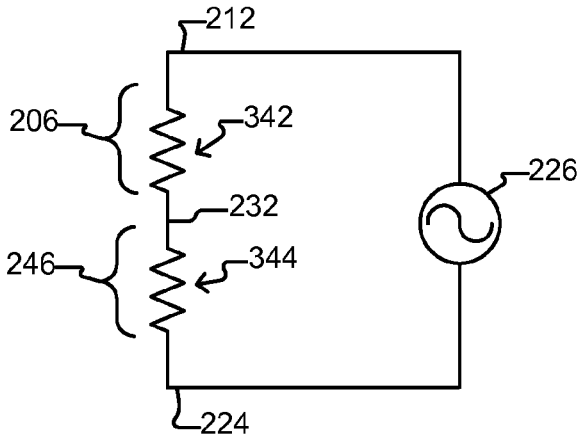
FIG. 3 is an equivalent circuit diagram of the OET device of FIG. 2A.

FIG. 3 illustrates an equivalent circuit in which the resistor 342 represents the impedance of the medium 206 in the chamber 204 and the resistor 344 represents the impedance of a switch mechanism 246—and thus the impedance between one of the DEP electrodes 232 on the inner surface 218 of the circuit substrate 216 and the second electrode 224. As noted, the impedance (represented by resistor 344) between a corresponding DEP electrode 232 and the second electrode 224 is greater than the impedance (represented by resistor 342) of the medium 206 while the switch mechanism 246 is in the off state, but the impedance (represented by resistor 344) between a corresponding DEP electrode 232 and the second electrode 224 becomes less than the impedance (represented by resistor 342) of the medium 206 while the switch mechanism 246 is in the on state. Turning a switch mechanism 246 on thus creates a non-uniform electrical field in the medium 206 generally from the DEP electrode 232 to a corresponding region on the electrode 212. The non-uniform electrical field can result in a DEP force on a nearby micro-object 208 (e.g., a micro-particle or biological object such as a cell or the like) in the medium 206. Because neither the switch mechanism 246 nor the portion of the circuit substrate 216 between the DEP electrode 232 and the second electrode 224 need be a photosensitive circuit element or even comprise photoconductive material, the switch mechanism 246 can provide a significantly lower impedance connection from a DEP electrode 232 to the second electrode 224 than in prior art OET devices, and the switch mechanism 246 can be much smaller than phototransistors used in prior art OET devices.

In some embodiments, the impedance of the off state of the switch mechanism 246 can be two, three, four, five, ten, twenty, or more times the impedance of the on state. Also, in some embodiments, the impedance of the off state of the switch 246 can be two, three, four, five, ten, or more times the impedance of the medium 206, which can be two, three, four, five, ten, or more times the impedance of the on state of the switch mechanism 246.

Even though the switch mechanism 246 need not be photoconductive, the control module 240 can be configured such that the switch mechanism 246 is controlled by a beam of light 250. The photosensitive element 242 of each control module 240 can be a photosenstive circuit element that is activated (e.g., turned on) and deactivated (e.g., turned off) in response to a beam of light 250. Thus, for example, as shown in FIG. 2B, the photosensitive element 242 can be disposed at a region on the inner surface 218 of the circuit substrate 216. A beam of light 250 (e.g., from a light source (not shown) such as a laser or other light source) can be selectively directed onto the photosensitive element 242 to activate the element 242, and the beam of light 250 thereafter can be removed from the photosensitive element 242 to deactivate the element 242. An output of the photosensitive element 242 can be connected to a control input of the switch mechanism 246 to switch the switch mechanism 246 between the off and on states.

In some embodiments, as shown in FIG. 2B, control circuitry 244 can connect the photosensitive element 242 to the switch mechanism 246. The control circuitry 244 can be said to "connect" the output of the photosensitive element 242 to the switch mechanism 246, and the photosensitive element 242 can be said to be connected to and/or controlling the switch mechanism 246, as long as the control circuitry 244 utilizes the output of the photosensitive element 242 to control the impedance state of the switch mechanism 246. In some embodiments, however, the control circuitry 244 need not be present, and the photosensitive element 242 can be connected directly to the switch mechanism 246. Regardless, the state of the switch mechanism 246 can be controlled by the beam of light 250 on the photosensitive element 242. For example, the state of the switch mechanism 246 can be controlled by the presence or absence of the beam of light 250 on the photosensitive element 242.

The control circuitry 244 can comprise analog circuitry, digital circuitry, a digital memory and digital processor operating in accordance with machine readable instructions (e.g., software, firmware, microcode, or the like) stored in the memory, or a combination of one or more of the forgoing. In some embodiments, the control circuitry 244 can comprise one or more digital latches (not shown), which can latch a pulsed output of the photosensitive element 242 caused by a pulse of a light beam 250 directed onto the photosensitive element 242. The control circuitry 244 can thus be configured (e.g., with one or more latches) to toggle the state of the switch mechanism 246 between the off state and the on state each time a pulse of the light beam 250 is directed onto the photosensitive element 242.

For example, a first pulse of the light beam 250 on the photosensitive element 242—and thus a first pulse of a positive signal output by the photosensitive element 242—can cause the control circuitry 244 to put the switch mechanism 246 into the on state. Moreover, the control circuitry 244 can maintain the switch mechanism 246 in the on state even after the pulse of the light beam 250 is removed from the photosensitive element 242. Thereafter, the next pulse of the light beam 250 on the photosensitive element 242—and thus the next pulse of the positive signal output by the photosensitive element 242—can cause the control circuitry 244 to toggle the switch mechanism 246 to the off state. Subsequent pulses of the light beam 250 on the photosensitive element 242—and thus subsequent pulses of the positive signal output by the photosensitive element 242—can toggle the switch mechanism 246 between the off and the on states.

As another example, the control circuitry 244 can control the switch mechanism 246 in response to different patterns of pulses of the light beam 250 on the photosensitive element 242. For example, the control circuitry 244 can be configured to set the switch mechanism 246 to the off state in response to a sequence of n pulses of the light beam 250 on the photosensitive element 242 (and thus n corresponding pulses of a positive signal from the photosensitive element 242 to the control circuitry 244) having a first characteristic and set the switch mechanism 246 to the on state in response to a sequence of k pulses (and thus k corresponding pulses of a positive signal from the photosensitive element 242 to the control circuitry 244) having a second characteristic, wherein n and k can be equal or unequal integers. Examples of the first characteristic and the second characteristic can include the following: the first characteristic can be that the n pulses occur at a first frequency, and the second characteristic can be that the k pulses occur at a second frequency that is different than the first frequency. As another example, the pulses can have different widths (e.g., a short width and a long width) like, for example, Morrse Code. The first characteristic can be a particular pattern of n short and/or long width pulses of the light beam 250 that constitutes a predetermined off-state code, and the second characteristic can be a different pattern of k short and/or long width pulses of the light beam 250 that constitutes a predetermined on-state code. Indeed, the foregoing examples can be configured to switch the switch mechanism 246 between more than two states. Thus, the switch mechanism 246 can have more and/or different states than merely an on state and an off state.

Figure 7:
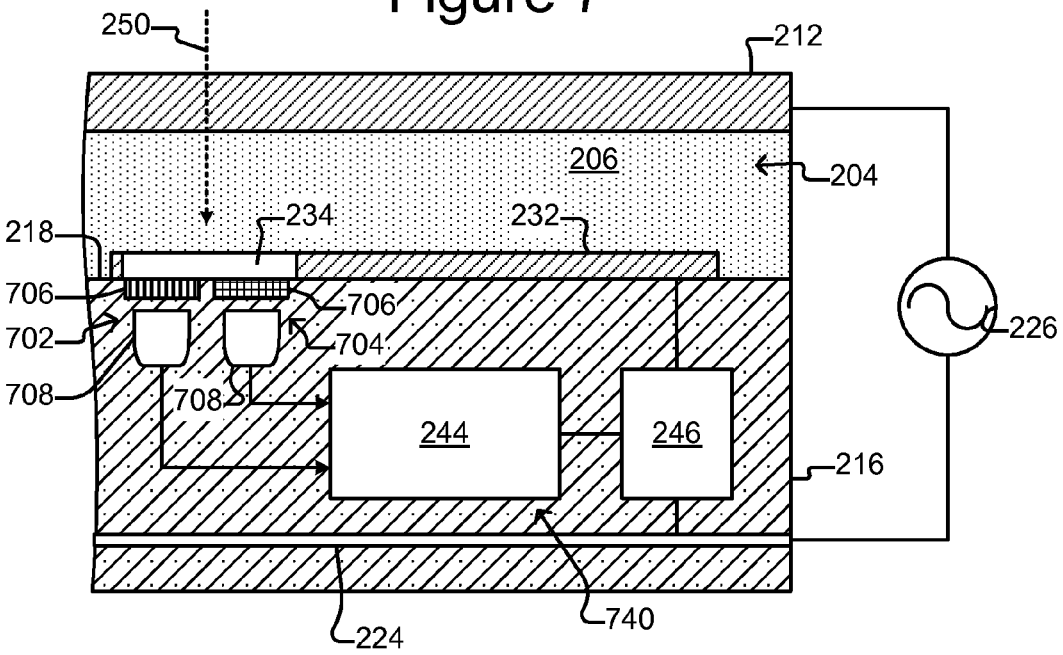
FIG. 7 is a partial, side cross-sectional view of an OET device having a color detector element according to some embodiments of the invention.

As yet another example, the control circuitry 244 can be configured to control the state of the switch mechanism 246 in accordance with a characteristic of the light beam 250 (and thus the corresponding pulse of a positive signal from the photosensitive element 242 to the control circuitry 244) other than merely the presence or absence of the beam 250. For example, the control circuitry 244 can control the switch mechanism 246 in accordance with the brightness of the beam 250 (and thus the level of a corresponding pulse of a positive signal from the photosensitive element 242 to the control circuitry 244). Thus, for example, a detected brightness level of the beam 250 (and thus a level of a corresponding pulse of a positive signal from the photosensitive element 242 to the control circuitry 244) that is greater than a first threshold but less than a second threshold can cause the control circuitry 244 to set the switch mechanism 246 to the off state, and a detected brightness level of the beam 250 (and thus a level of a corresponding pulse of a positive signal from the photosensitive element 242 to the control circuitry 244) that is greater than the second threshold can cause the control circuitry 244 to set the switch mechanism 246 to the on state. In some embodiments, there can be a two, five, ten, or more times difference between the first brightness level and the second brightness level. FIG. 7, which is discussed below, illustrates an example in which the control circuitry 244 can control the state of the switching mechanism 246 in accordance with the color of the light beam 250. Again, the foregoing examples can be configured to switch the switch mechanism 246 between more than two states.

As still another example, the control circuitry 244 can be configured to control the state of the switch mechanism 246 in accordance with any combination of the foregoing characteristics of the light beam 250 or multiple characteristics of the light beam 250. For example, the control circuitry 244 can be configured to set the switching mechanism 246 to the off state in response to a sequence of n pulses within a particular frequency band of the light beam 250 and to the on state in response to the brightness of the light beam 250 exceeding a predetermined threshold.

The control module 240 is thus capable of controlling a DEP electrode 232 on the inner surface 218 of the circuit substrate 216 in accordance with the presence or absence of a beam of light 250, a characteristic of the light beam 250, or a characteristic of a sequence of pulses of the light beam 250 at a different region (e.g., corresponding to the location of the photosensitive element 242) of the inner surface 218, where the different region is spaced apart from the first DEP electrode 232. The photosensitive element 242, the control circuitry 244, and/or the switch element 246 are thus examples of means for activating a DEP electrode 232 at a first region (e.g., any portion of a DEP electrode 232 not disposed over a corresponding photosensitive element 242) on an inner surface (e.g., 218) of a circuit substrate (e.g., 216) in response to a beam of light (e.g., 250) directed onto a second region (e.g., corresponding to the photosensitive element 242) of the inner surface 218, where the second region is spaced apart on the inner surface 218 from the first region.

As illustrated in FIGS. 2B and 2C, there can be multiple (e.g., many) control modules 240 each configured to control a different DEP electrode 232 on the inner surface 218 of the circuit substrate 216. The OET device 200 of FIGS. 2A-2C can thus comprise many DEP electrodes in the form of DEP electrodes 232 each controllable by directing or removing a beam of light 250 on a photosensitive element 242. Moreover, at least a portion of each DEP electrode 232 can be spaced apart on the inner surface 218 from the corresponding photosensitive element 242—and thus the region on the inner surface where light 250 is directed—that controls the state of the DEP electrode 232.

The illustrations in FIGS. 2A-2C are examples only, and variations are contemplated. For example, as noted, there need not be control circuitry 244, and the photosensitive elements 242 can be connected directly to the switch mechanisms 246. As another example, each control module 240 need not include control circuitry 244. Instead, one or more instances of the control circuitry 244 can be shared among multiple photosensitive elements 242 and switch mechanisms 246. As yet another example, DEP electrodes 232 need not include distinct terminals on the surface 218 of the circuit substrate 216 but can instead be regions of the surface 218 where the switch mechanisms 246 are in electrical contact with the medium 206 in the chamber 204.

Figure 4:
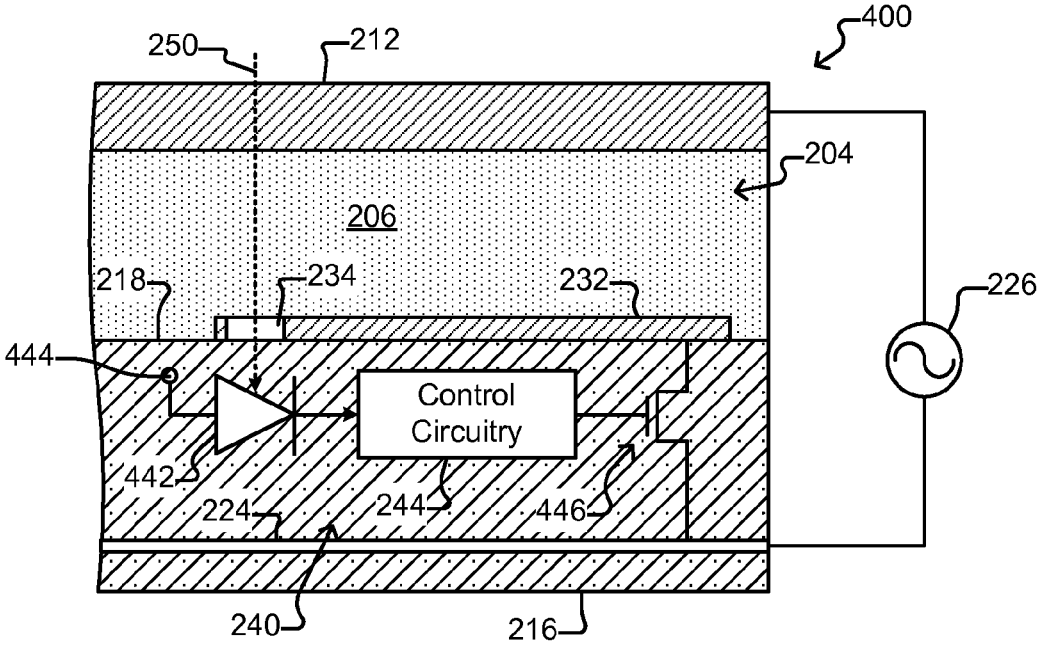
FIG. 4 shows a partial, side cross-sectional view of an OET device in which the photosensitive element of FIGS. 2A-2C comprises a photodiode and the switch mechanism comprises a transistor according to some embodiments of the invention.
Figure 5:
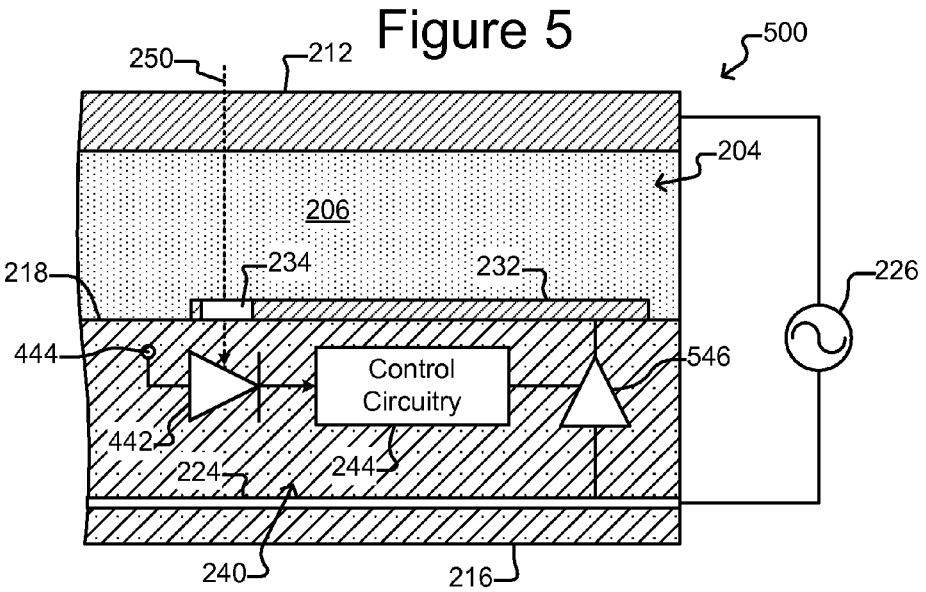
FIG. 5 shows a partial, side cross-sectional view of an OET device in which the photosensitive element of FIGS. 2A-2C comprises a photodiode and the switch mechanism comprises an amplifier according to some embodiments of the invention.
Figure 6:
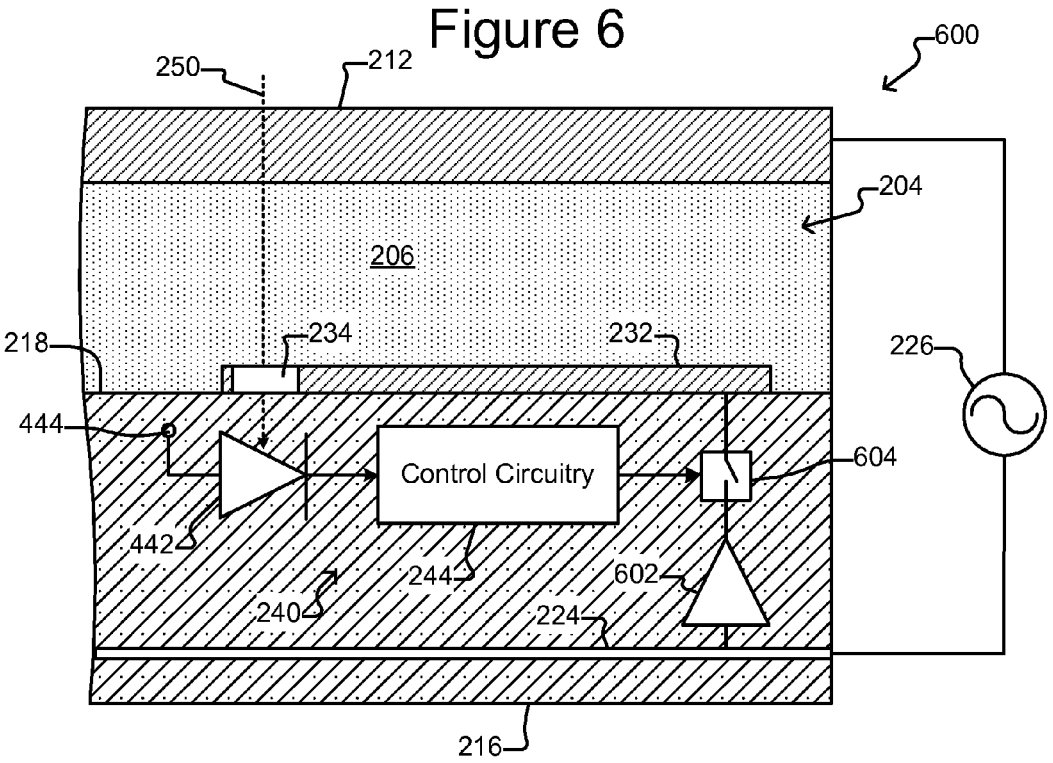
FIG. 6 shows a partial, side cross-sectional view of an OET device in which the photosensitive element of FIGS. 2A-2C comprises a photodiode and the switch mechanism comprises an amplifier and a switch according to some embodiments of the invention.

FIGS. 4-6 illustrate various embodiments and exemplary configurations of the photosensitive element 242 and the switch mechanism 246 of FIGS. 2A-2C.

FIG. 4 illustrates an OET device 400 that can be similar to the OET device 200 of FIGS. 2A-2C except that the photosensitive element 242 can comprise a photodiode 442 and the switch mechanism 246 can comprise a transistor 446. Otherwise, the OET device 400 can be the same as the OET device 200, and indeed, like numbered elements in FIGS. 2A-2C and 4 can be the same. As noted above, the circuit substrate 216 can comprise a semiconductor material, and the photodiode 442 and transistor 446 can be formed in layers of the circuit substrate 216 as is known in the field of semiconductor manufacturing.

An input 444 of the photodiode 442 can be biased with a direct current (DC) power source (not shown). The photodiode 442 can be configured and positioned so that a light beam 250 directed at a location on the inner surface 218 that corresponds to the photodiode 442 can activate the photodiode 442, causing the photodiode 442 to conduct and thus output a positive signal to the control circuitry 244. Removing the light beam 250 can deactivate the photodiode 442, causing the photodiode 442 to stop conducting and thus output a negative signal to the control circuitry 244.

The transistor 446 can be any type of transistor, but need not be a phototransistor. For example, the transistor 446 can be a field effect transistor (FET) (e.g., a complementary metal oxide semiconductor (CMOS) transistor), a bipolar transistor, or a bi-MOS transistor.

If the transistor 446 is a FET transistor as shown in FIG. 4, the drain or source can be connected to the DEP electrode 232 on the inner surface 218 of the circuit substrate 216 and the other of the drain or source can be connected to the second electrode 224. The output of the photodiode 442 can be connected (e.g., by the control circuitry 244) to the gate of the transistor 446. Alternatively, the output of the photodiode 442 can be connected directly to the gate of the transistor 446. Regardless, the transistor 446 can be biased so that the signal provided to the gate turns the transistor 446 off or on.

If the transistor 446 is a bipolar transistor, the collector or emitter can be connected to the DEP electrode 232 on the inner surface 218 of the circuit substrate 216 and the other of the collector or emitter can be connected to the second electrode 224. The output of the photodiode 442 can be connected (e.g., by the control circuitry 244) to the base of the transistor 446. Alternatively, the output of the photodiode 442 can be connected directly to the base of the transistor 446. Regardless, the transistor 446 can be biased so that the signal provided to the base turns the transistor 446 off or on.

Regardless of whether the transistor 446 is a FET transistor or a bipolar transistor, the transistor 446 can function as discussed above with respect to the switch mechanism 226 of FIGS. 2A-2C. That is, turned on, the transistor 446 can provide a low impedance electrical path from the DEP electrode 232 to the second electrode 224 as discussed above with respect to the switch mechanism 226 in FIGS. 2A-2C. Conversely, turned off, the transistor 446 can provide a high impedance electrical path from the DEP electrode 232 to the second electrode 224 as described above with respect to the switch mechanism 226.

FIG. 5 illustrates an OET device 500 that can be similar to the OET device 200 of FIGS. 2A-2C except that the photosensitive element 242 comprises the photodiode 442 (which can be the same as described above with respect to FIG. 4) and the switch mechanism 246 comprises an amplifier 546, which need not be photoconductive. Otherwise, the OET device 500 can be the same as the OET device 200, and indeed, like numbered elements in FIGS. 2A-2C and 5 can be the same. As noted above, the circuit substrate 216 can comprise a semiconductor material, and the amplifier 546 can be formed in layers of the circuit substrate 216 as is known in the field of semiconductor processing.

The amplifier 546 can be any type of amplifier. For example, the amplifier 546 can be an operational amplifier, one or more transistors configured to function as an amplifier, or the like. As shown, the control circuitry 244 can utilize the output of the photodiode 442 to control the amplification level of the amplifier 546. For example, control circuitry 244 can control the amplifier 546 to function as discussed above with respect to the switch mechanism 226 of FIGS. 2A-2C. That is, in the absence of the light beam 250 on the photodiode 442 (and thus the absence of an output from the photodiode 442), the control circuitry 244 can turn the amplifier 546 off or set the gain of the amplifier 546 to zero, effectively causing the amplifier 546 to provide a high impedance electrical connection from the DEP electrode 232 to the second electrode 224 as discussed above with respect to the switch mechanism 246. Conversely, the presence of the light beam 250 on the photodiode 442 (and thus an output from the photodiode 442) can cause the control circuitry 244 to turn the amplifier 546 on or set the gain of the amplifier 546 to a non-zero value, effectively causing the amplifier 546 to provide a low impedance electrical connection from the DEP electrode 232 to the second electrode 224 as discussed above with respect to the switch mechanism 246.

The OET device 600 of FIG. 6 can be similar to the OET device 500 of FIG. 5 except that the switch mechanism 246 (see FIGS. 2A-2C) can comprise a switch 604 in series with an amplifier 602. The switch 604 can comprise any kind of electrical switch including a transistor such as transistor 442 of FIG. 4. The amplifier 602 can be like the amplifier 546 of FIG. 5. The switch 604 and amplifier 602 can be formed in the circuit substrate 216 generally as discussed above.

The control circuitry 244 can be configured to control whether the switch 604 is open or closed in accordance with the output of the photodiode 442. Alternatively, the output of the photodiode 442 can be connected directly to the switch 604. Regardless, when the switch 604 is open, the switch 604 and amplifier 602 can provide a high impedance electrical connection from the DEP electrode 232 to the second electrode 224 as discussed above. Conversely, while the switch 604 is closed, the switch 604 and amplifier 602 can provide a low impedance electrical connection from the DEP electrode 232 to the second electrode 224 as discussed above.

FIG. 7 illustrates a partial, side cross-sectional view of an OET device 700 that can be like the device 200 of FIGS. 2A-2C except that each of one or more (e.g., all) of the photosensitive elements 242 can be replaced with a color detector element 710. One color detector element 710 is shown in FIG. 7, but each of the photosensitive elements 242 in FIGS. 1A-1C can be replaced with such an element 710. The control module 740 in FIG. 7 can otherwise be like the control module 240 in FIGS. 1A-1C, and like numbered elements in FIGS. 1A-1C and 7 are the same.

As shown, a color detector element 710 can comprise a plurality of color photo detectors 702, 704 (two are shown but there can be more). Each pass color detector 702, 704 can be configured to provide a positive signal to the control circuitry 244 in response to a different color of the light beam 250. For example, the photo detector 702 can be configured to provide a positive signal to the control circuitry 244 when a light beam 250 of a first color is directed onto the photo detectors 702, 704, and the photo detector 704 can be configured to provide a positive signal to the control circuitry 244 when the light beam 250 is a second color, which can be different than the first color.

As shown, each photo detector 702, 704 can comprise a color filter 706 and a photo sensitive element 708. Each filter 706 can be configured to pass only a particular color. For example, the filter 706 of the first photo detector 702 can pass substantially only a first color, and the filter 706 of the second photo detector 704 can pass substantially only a second color. The photo sensitive elements 708 can both be similar to or the same as the photo sensitive element 242 in FIGS. 2A-2C as discussed above.

The configurations of the color photo detectors 702, 704 shown in FIG. 7 are an example only, and variations are contemplated. For example, rather than comprising a filter 706 and a photo sensitive element 708, one or both of the color photo detectors 702, 704 can comprise a photo-diode configured to turn on only in response to light of a particular color.

Regardless, the control circuitry 244 can be configured to set the switch mechanism 246 to one state (e.g., the on state) in response to a beam 250 pulse of the first color and to set the switch mechanism 246 to another state (e.g., the off state) in response to a beam 250 pulse of the second color. As mentioned, the color detector element 710 can comprise more than two color photo detectors 702, 704, and the control circuitry 244 can thus be configured to switch the switch mechanism 246 among more than two different states.

Figure 8:
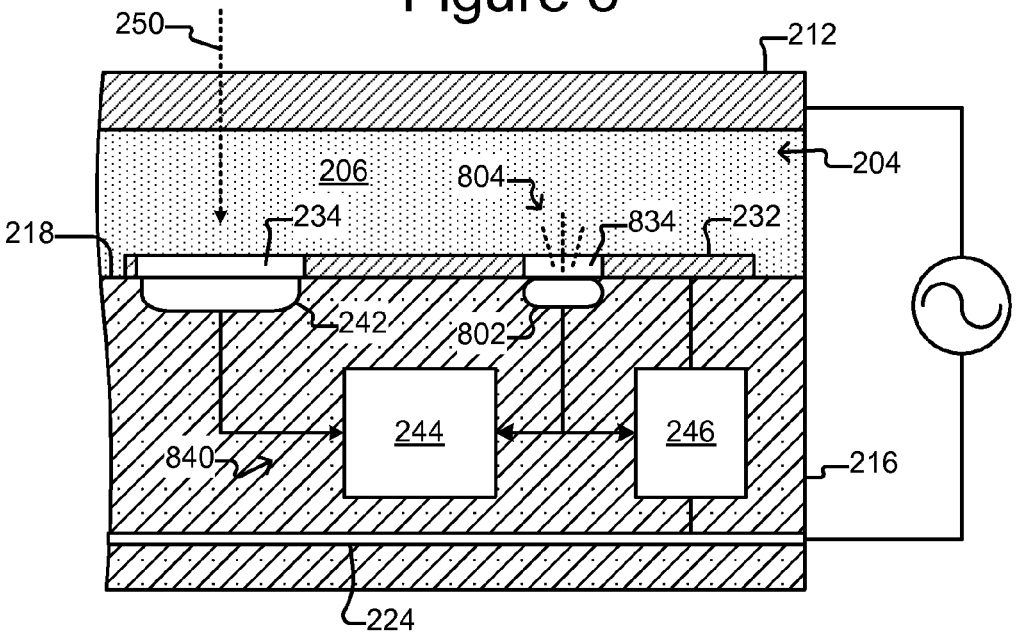
FIG. 8 illustrates a partial, side cross-sectional view of an OET device with an indicator element for indicating whether a DEP electrode is activated according to some embodiments of the invention.

FIG. 8 is a partial, side cross-sectional view of an OET device 800 that can be like the device 200 of FIGS. 2A-2C except that each control module 840 can further include an indicator element 802. That is, the device 800 can be like the device 200 of FIGS. 2A-2C except a control module 840 can replace each control module 240, and there can thus be an indicator element 802 associated with each DEP electrode 232. Otherwise, the device 800 can be like device 200 in FIGS. 2A-2C, and like numbered elements in FIGS. 2A-2C and 8 are the same.

As shown, the indicator element 802 can be connected to the output of the control circuitry 244, which can be configured to set the indicator element 802 to different states each of which corresponds to one of the possible states of the switch mechanism 246. Thus, for example, the control circuitry 244 can turn the indicator element 802 on while the switch mechanism 246 is in the on state and turn the indicator element 802 off while the switch mechanism 246 is in the off state. In the foregoing example, the indicator element 802 can thus be on while its associated DEP electrode 232 is activated and off while the DEP electrode 232 is not activated.

The indicator element 802 can provide a visional indication (e.g., emit light 804) only when turned on. Non-limiting examples of the indicator element 802 include a light source such as a light emitting diode (which can be formed in the circuit substrate 216), a light bulb, or the like. As shown, the DEP electrode 232 can include a second opening 834 (e.g., window) for the indicator element 802. Alternatively, the indicator element 802 can be spaced away from the DEP electrode 232 and thus not covered by the DEP electrode 232, in which case, there need not be a second window 834 in the DEP electrode 232. As yet another alternative, the DEP electrode 232 can be transparent to light, which case, there need not be a second window 834 even if the DEP electrode 232 covers the indicator element 802.

Figure 9:
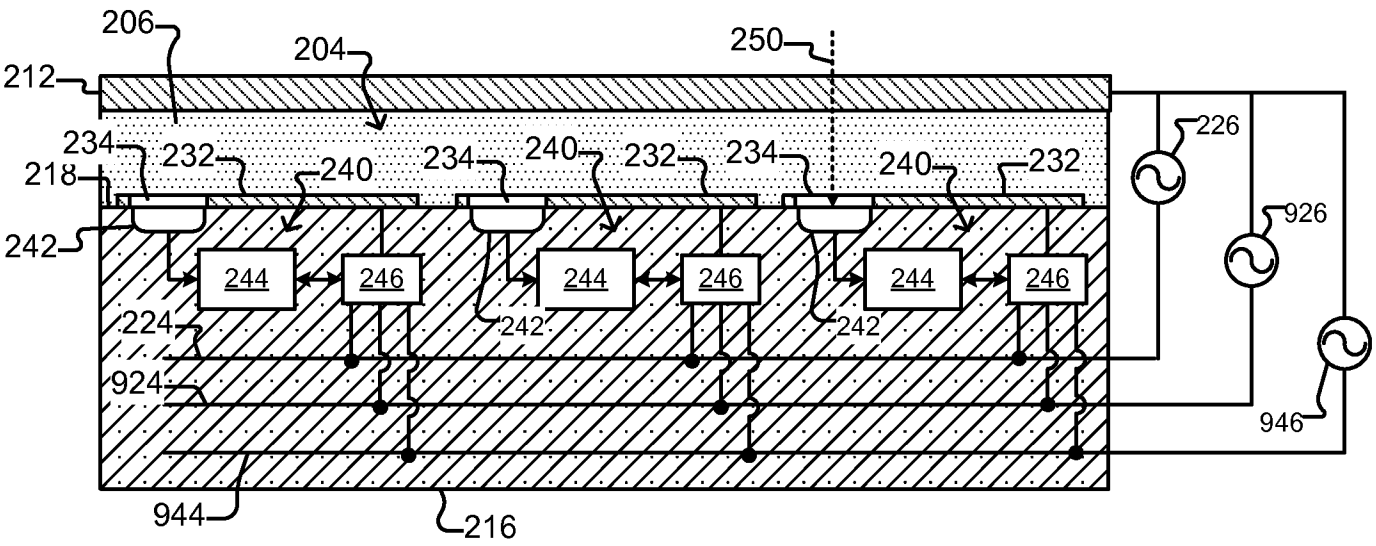
FIG. 9 illustrates a partial, side cross-sectional view of an OET device with multiple power supplies connected to multiple additional electrodes according to some embodiments of the invention.

FIG. 9 is a partial, side cross-sectional view of an OET device 900 that can be like the device 200 of FIGS. 2A-2C except that the device 900 can comprise not only the second electrode 224 but one or more additional electrodes 924, 944 (two are shown but there can be one or more than two) and a corresponding plurality of additional power sources 926, 946. Otherwise, the device 900 can be like device 200 in FIGS. 2A-2C, and like numbered elements in FIGS. 2A-2C and 9 are the same.

As shown, each switch mechanism 246 can be configured to connect electrically a corresponding DEP electrode 232 to one of the electrodes 224, 924, 944. A switch mechanism 246 can thus be configured to selectively connect a corresponding DEP electrode 232 to the second electrode 224, a third electrode 924, or a fourth electrode 944. Each switch mechanism 246 can also be configured to disconnect the first electrode 212 from all of the electrodes 224, 924, 944.

As also shown, the power source 226 can be connected to (and thus provide power between) the first electrode 212 and the second electrode 224 as discussed above. The power source 926 can be connected to (and thus provide power between) the first electrode 212 and the third electrode 924, and the power source 946 can be connected to (and thus provide power between) the first electrode 212 and the fourth electrode 944.

Each electrode 924, 944 can be generally like the second electrode 224 as discussed above. For example, each electrode 924, 944 can be electrically insulated from the medium 206 in the channel 204. As another example, each electrode 924, 944 can be part of a metal layer on the surface 218 of or inside the circuit substrate 216. Each power source 926, 946 can be an alternating current (AC) power source like the power source 226 as discussed above.

The power sources 926, 946, however, can be configured differently than the power source 226. For example, each power source 226, 926, 946 can be configured to provide a different level of voltage and/or current. In such an example, each switch mechanism 246 can thus switch the electrical connection from a corresponding DEP electrode 232 between an "off" state in which the DEP electrode 232 is not connected to any of the electrodes 224, 924, 944 and any of multiple "on" states in which the DEP electrode 232 is connected to any one of the electrodes 224, 924, 944.

As another example of how the power sources 226, 926, 946 can be configured differently, each power source 226, 926, 946 can be configured to provide power with a different phase shift. For example, in an embodiment comprising the electrodes 224, 924 and the power sources 226, 926 (but not the electrode 944 and power source 946), the power source 926 can provide power that is approximately (e.g., plus or minus ten percent) one hundred eighty (180) degrees out of phase with the power provided by the power source 226. In such an embodiment, each switch mechanism 246 can be configured to switch between connecting a corresponding DEP electrode 232 to the second electrode 224 and the third electrode 924. The device 900 can be configured so that the corresponding DEP electrode 232 is activated (and thus turned on) while the DEP electrode 232 is connected to one of the electrodes 224, 924 (e.g., 224) and deactivated (and thus turned off) while connected to the other of the electrodes 224, 924 (e.g., 924). Such an embodiment can reduce leakage current from a DEP electrode 232 that is turned off as compared to the device 200 of FIGS. 2A-2C.

It is noted that one or more of the following can comprise examples of means for activating a DEP electrode at a first region of the inner surface of the circuit substrate in response to a beam of light directed onto a second region of the inner surface, where the second region is spaced apart from the first region; activating means further for selectively activating a plurality of DEP electrodes at first regions of the inner surface of the circuit substrate in response to beams of light directed onto second regions of the inner surface, where the each second region is spaced apart from each the first region; activating means further for activating the DEP electrode in response to the beam of light having a first characteristic, and deactivating the DEP electrode in response to the beam of light having a second characteristic; activating means further for activating the DEP electrode in response to a sequence of n pulses of the beam of light having a first characteristic; and activating means further for deactivating the DEP electrode in response to a sequence of k pulses of the beam of light having a second characteristic: the photosensitive element 242, including the photodiode 442 and/or the color detector element 710; the control circuitry 244 configured in any manner described or illustrated herein; and/or the switch mechanism 246 include the transistor 446, the amplifier 546, and/or the amplifier 602 and switch 604.

Figure 10:
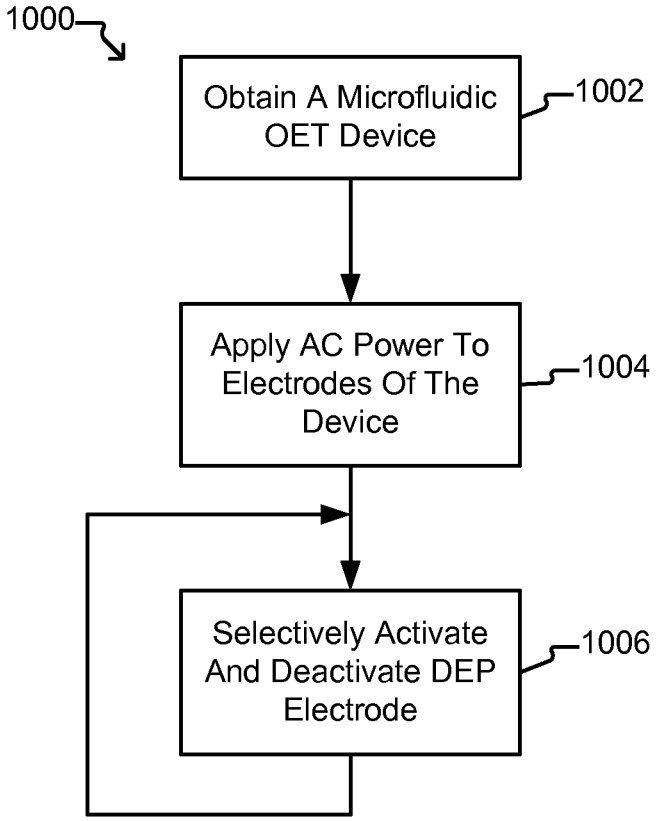
FIG. 10 illustrates an example of a process of operating an OET device like the devices of FIGS. 2A-2C and 4-9 according to some embodiments of the invention.

FIG. 10 illustrates a process 1000 for controlling DEP electrodes in a microfluidic OET device according to some embodiments of the invention. As shown, at step 1002, a micro-fluidic OET device can be obtained. For example, any of the microfluidic OET devices 200, 400, 500, 600, 700, 800, 900 of FIGS. 2A-2C and 4-9, or similar devices, can be obtained at step 1002. At step 1004, AC power can be applied to electrodes of the device obtained at step 1002. For example, as discussed above, the AC power source 226 can be connected to a first electrode 212 that is in electrical contact with the medium 206 in the chamber 204 and a second electrode 224 that is insulated from the medium 206. At step 1006, DEP electrodes of the device obtained at step 1002 can be selectively activated and deactivated. For example, as discussed above DEP electrodes 232 can be selectively activated and deactivated by selectively directing light beams 250 onto and removing light beams 250 from photosensitive elements 242 (e.g., the photodiode 442 of FIGS. 4, 5, and 6) to switch the impedance state of the switching mechanism 246 (e.g., the transistor 446 of FIG. 4, the amplifier 556 of FIG. 5, and the switch 602 and amplifier 604 of FIG. 5) as discussed above.

Although specific embodiments and applications of the invention have been described in this specification, these embodiments and applications are exemplary only, and many variations are possible.

We claim:

1. A microfluidic apparatus, comprising:

a circuit substrate comprising an inner surface;

an electrically conductive terminal on the inner surface;

a switch mechanism that connects the electrically conductive terminal to a first power electrode in a first on state and disconnects the electrically conductive terminal from the first power electrode in an off state; and a photosensitive element that connects to the switch mechanism, wherein an output of the photosensitive element controls whether the switch mechanism is in the first on state and the off state.

2. The apparatus of claim 1, wherein the photosensitive element is on the inner surface and the electrically conductive terminal is spaced apart from the photosensitive element on the inner surface.

3. The apparatus of claim 1, wherein the electrically conductive terminal is disposed, at least partially, around the photosensitive element.

4. The apparatus of claim 1, wherein the electrically conductive terminal is transparent to light and the electrically conductive terminal covers the photosensitive element.

5. The apparatus of claim 1, wherein the inner surface defines part of a chamber and the chamber comprises a liquid medium.

6. The apparatus of claim 1, wherein the output of the photosensitive element is received by a control circuitry that toggles the switch mechanism between the first on state and the off state responsive to the output of the photosensitive element.

7. The apparatus of claim 1, wherein the photosensitive element comprises a photodiode.

8. The apparatus of claim 7, wherein the photodiode is configured to provide the output in response to a color of light.

9. The apparatus of claim 1, wherein the photosensitive element is configured to provide the output in response to one or more pulses of light.

10. The apparatus of claim 1, further comprising a color filter configured to pass a specific color of light to the photosensitive element.

11. The apparatus of claim 1, wherein the switch mechanism comprises a transistor.

12. The apparatus of claim 11, wherein the transistor is selected from the group of: a field effect transistor, a bipolar transistor and a bi-MOS transistor.

13. The apparatus of claim 1, wherein the photosensitive element comprises a photodiode and the switch mechanism comprises an amplifier.

14. The apparatus of claim 13, wherein the switch mechanism further comprises a switch in series with the amplifier.

15. The apparatus of claim 1, further comprising a second power electrode, wherein the switch mechanism connects the electrically conductive terminal to the second power electrode in a second on state and disconnects the electrically conductive terminal from the second power electrode in the off state.

16. The apparatus of claim 15, further comprising a third power electrode, wherein the switch mechanism connects the electrically conductive terminals to the third power electrode in a third on state and disconnects the electrically conductive terminal from the third power electrode in the off state.

17. The apparatus of claim 1, further comprising a second power electrode and wherein the switch mechanism connects the electrically conductive terminal to the first power electrode in the first on state and connects the electrically conductive terminal to the second power electrode in the off state.

18. A microfluidic apparatus, comprising:

a circuit substrate comprising an inner surface;

a chamber configured to contain a liquid medium disposed on the inner surface;

a switch mechanism located in a region of the inner surface that is in electrical contact with the liquid medium and connected to a power electrode in an on state and disconnected from the power electrode in an off state; and a photosensitive element on the inner surface that connects to the switch mechanism and controls whether the switch mechanism is in the on state and the off state.

19. A method of controlling a microfluidic device comprising a circuit substrate, a photosensitive element disposed on an inner surface of the circuit substrate and an electrically conductive terminal disposed on the inner surface of the circuit substrate, the method comprising:

selectively directing light onto the photosensitive element, wherein the photosensitive element generates an output responsive to the light directed onto the photosensitive element;

switching a switch mechanism between an on state and an off state responsive to the output generated by the photosensitive element, wherein the switch mechanism connects the electrically conductive terminals to a first power electrode in the on state and disconnects the electrically conductive terminal from the first power electrode in the off state.

20. The method of claim 19, wherein the microfluidic device further comprises control circuitry that connects the photosensitive element to the switch mechanism, and wherein switching the switch mechanism between the on state and the off state comprises the control circuitry:

receiving the output generated by the photosensitive element; and providing an input to the switch mechanism responsive to the output received from the photosensitive element.

21. The method of claim 20, wherein:

selectively directing light onto the photosensitive element comprises directing one or more pulses of light onto the photosensitive element, wherein the photosensitive element generates a pulse of positive signal output responsive to the one or more pulses of light; and switching the switch mechanism between the on state and the off state is responsive to the pulse of positive signal output.

22. The method of claim 21, wherein:

selectively directing light onto the photosensitive element comprises directing a pattern of pulses of light onto the photosensitive element, wherein the photosensitive element generates a pulse of positive signal output responsive to the pattern of pulses of light; and switching the switch mechanism between the on state and the off state is responsive to the pulse of positive signal output.

23. The method of claim 22, wherein:

selectively directing light onto the photosensitive element comprises directing a color of light onto the photosensitive element, wherein the photosensitive element generates an output responsive to the color of light directed onto the photosensitive element;

switching the switch mechanism between the on state and the off state is responsive to the output generated by the photosensitive element.

* * * * *